United States Patent [19]

Southard

[11] Patent Number: 4,873,777

[45] Date of Patent: Oct. 17, 1989

[54] PRESS FIT GUN CRADLE FOR FIREARM MAINTENANCE AND REPAIR

[76] Inventor: Robert C. Southard, HC 32, Box 3-A, Locust Grove, Ark. 72550

[21] Appl. No.: 246,082

[22] Filed: Sep. 19, 1988

Related U.S. Application Data

[63] Continuation-in-part of Ser. No. 158,945, Feb. 22, 1988, Pat. No. 4,807,381.

[51] Int. Cl.[4] ..... F41C 29/00

[52] U.S. Cl. ..... 42/94; 211/64

[58] Field of Search ..... 42/94; 211/64

[56] References Cited

U.S. PATENT DOCUMENTS

| | | | |
|---|---|---|---|
| 3,361,265 | 1/1968 | Wernimont | 42/94 |
| 3,964,613 | 6/1976 | Anderson, Jr. | 211/64 |
| 4,449,314 | 5/1984 | Sorensen | 42/94 |
| 4,807,381 | 2/1989 | Southard | 42/94 |

*Primary Examiner*—Deborah L. Kyle
*Assistant Examiner*—Richard W. Wendtland
*Attorney, Agent, or Firm*—Stephen D. Carver

[57] ABSTRACT

A cradle-like gun cradle for firearms frictionally, firmly receives long guns such as rifles or shotguns, which are press fitted into opposed grooves against compression and friction forces from one or more leather straps. In the best mode a rigid, generally planar base supported by a pair of spaced apart, adjustable lower stabilizers comprises a pair of spaced-apart, rigid sides extending vertically upwardly from the planar base. The stabilizers can be adjusted to accommodate for an irregular work surface, and the length of the stabilizers is greater than the width of the planar base. The sides are disposed oppositely from one another in substantially axial alignment. Each side comprises a top provided with at least one groove into which at least a portion of a firearm may be fitted. A leather strip overlies the top of each side, extending between and secured within suitable channels adjacent each groove. These strips permanently occupy the top surface of the groove. Additionally a reservoir of leather straps is formed upon the sides adjacent the grooves so that one or more leather straps may be user selected to surround the firearm to provide a "snap-fit" phenomena as the firearm is compressively fitted into the grooves. Thus a firearm may be nondestructively and snugly snap fitted into temporary retention within the grooves by the combined compression and frictional effects of the one or more leather straps which in effect shim the firearm. Preferably the base includes a part-receptive recess for temporarily storing miscellaneous items.

9 Claims, 3 Drawing Sheets

FIG. 1
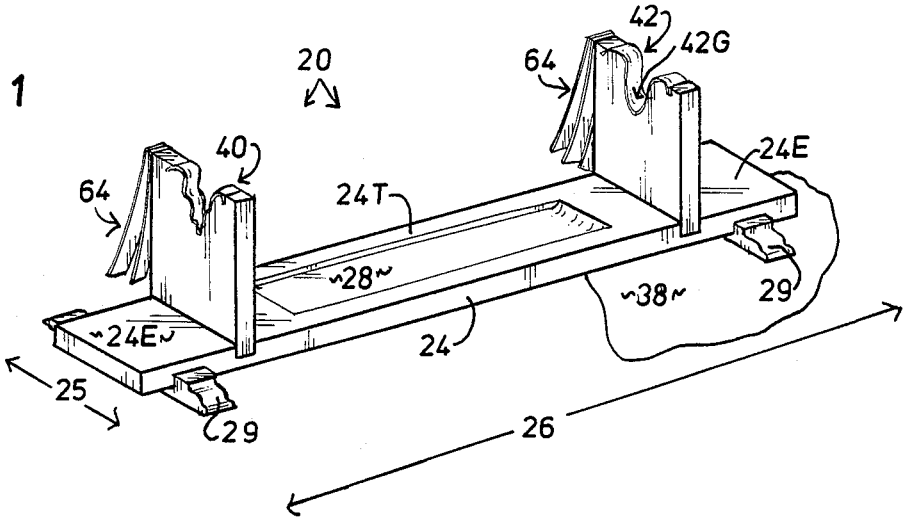
FIG. 2
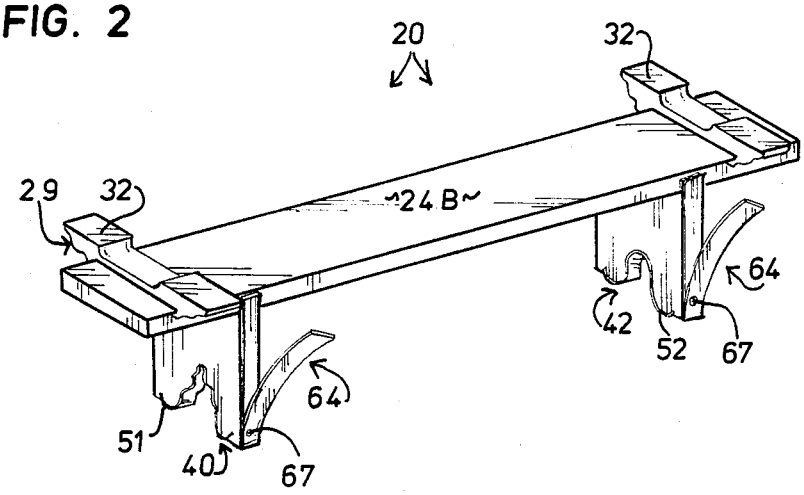
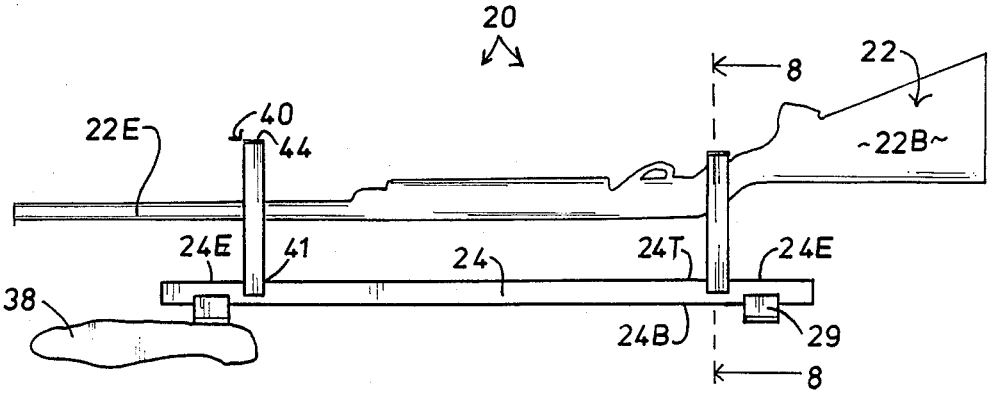
FIG. 3

PRESS FIT GUN CRADLE FOR FIREARM MAINTENANCE AND REPAIR

CROSS REFERENCE TO RELATED APPLICATION

This application is a continuation in part of U.S. Ser. No. 158,945, filed Feb. 22, 1988, entitled "Gun Storage and Maintenance Work Bench," now U.S. Pat. No. 4,807,381 Group Art Unit 221.

BACKGROUND OF THE INVENTION

The present invention relates to firearm work benches or cradles of the type adapted to support a firearm (i.e. a long gun) in a user-convenient generally horizontal orientation for service or repair. More particularly, the present invention is related to a self-standing cradle-like work bench or support which aids in the periodic maintenance, servicing, or adjustment of firearms such as rifles, shotguns and the like. The invention is believed properly classified in U.S. utility class 42, subclass 94.

Numerous applications exist for a reliable support bench. As will be recognized by modern gun smiths, firearms hobbyists and the like, proper firearm maintenance may entail any of a variety of tasks, ranging from periodic cleaning and oiling to the installation of optional accessories such as scopes, lanyards, and the like. A good work bench is also necessary for conveniently implementing safe and reliable firearm repairs.

In the prior art, a plurality of firearm-supporting rest benches are known. They may be called "gun vices", "gun supports", "work benches", "firearm cradles" or the like. As used herein, the term "gun cradle" shall refer generally and interchangeably to all such devices. Most of the prior art devices include some form of planar surface from which vertical support members extend upwardly. Usually an elevated member receives the stock or barrel of the firearm, and a lower companion member emanating from the base receives the shoulder stock.

Probably the most important type of firearm work bench comprises a form of vice. Such a vice must be strong enough to firmly support a variety of different gun barrels and stocks. Known prior art gun vices usually include jaws with a plurality of teeth for firmly engaging the gun part embraced. Typically, a gun vice will include some form of clamp at its opposite ends to firmly secure the firearm.

Representative of typical prior art gun vices are the vice presently sold under the trademark "MOUNTAIN MEADOW" and a solid mahogany gun vice seen in the Autumn 1987 catalog of Sportsman's Inc.

Additionally, U.S. Pat. No. 4,449,314 issued to Sorensen on May 22, 1984 discloses a fire arm support device, in which a base supports a pair of opposed wedges equipped with grooves for receiving a firearm. U.S. Pat. No. 3,964,613 issued to Anderson, Jr. provides a rifle support, which does not include stabilizers or the like, but which does does disclose spaced apart grooves in upright sides for receiving a fire arm. Similarly, Burton U.S. Pat. No. 3,913,746 discloses a utility gun rack for boats which includes a pair of grooved ends adapted to have fire arms supported and extended therebetween. Notched or grooved apparatus which can receive fire arms is also seen in U.S. Pat. Nos. 3,329,278; 3,477,586; and, 3,288,304.

Firearm supports or bench rests of lesser relevance include U.S. Pat. Nos. 4,558,531; 3,012,350; 2,877,689; 3,125,929; 3,711,984; 4,207,699; 4,007,554; 4,055,017; 2,740,530; 4,409,751; and, 4,026,057.

However, a major disadvantage of such prior art vices is that the finish of the firearm disposed thereon may easily become marred or scratched by abrasion against the rigid supporting surfaces. Scratches and other surface blemishes may seriously undermine the value of the firearm, particularly if the gun barrel or metal parts of the gun have been blued. As will be well appreciated by those skilled in the art, rebelling of firearms may be extremely tedious, time-consuming, and expensive.

The compressive jaws of typical prior art gun vices may also seriously damage the expensive treated surface of crafted wooden parts of the firearm, such as the butt or stock. Even plastic stocks are highly susceptible to scratches and other surface mutilations. Hence it would be desirable to provide a work bench which is adapted to firmly retain the firearm in position for maintenance or repair without the use of compressive jaws. It would also be desirable to provide a firearm work bench which would receive the trigger guard so that the firearm may be supported in a variety of selective positions.

An acceptable gun cradle device has to have "hold power" and "rock solid stability." These two forces oppose each other and they have to be brought together, or "bonded." No prior firearms cradle invention , to my knowledge, has ever accomplished this. A new locking system in this art is called for; it suggests stabilizers, with only two holding points.

The Sorrenson principle mentioned in the aforementioned patent was well know in ancient times. It was used to build pyramids, but it was much too powerful for delicate firearms. I designed my locking system to "press lock" and "lift unlock" since I want a device that would lock loosely, lock to fit, lock to snug. and lock with enough power to hold tight and solid yet not enough to damage firearms. I want to select a user-appropriate fit. This would seem impossible and it almost was. I figured out the locking system by known principles, facts and natural energy force (i.e. resistance.)

In compression everything and particle is absolute equal in force within and effects every known and unknown angle exactly the same. My locking system "presses to lock," and "lifts to unlock." For the best compression resistance lock for my applications, I used leather strips.

Holding and stabilizing firearms, or cross bows for maintenance, repair, display, bore sight adjustment, bench rest, rack to name a few is a major problem that has challenged mankind since the time they were invented. Devices have been invented to help with some of the basic steps and problems which I will describe. Cradle vices limited to one or two. Position functions with holding power, but they are conventionally equipped with no stabilizers. Other type locking cradle "sorrenson" wooden wedge block incline locking device, but no stabilizers. Gun racks, transporting racks, gun cases, this type was not designed for and would not perform for maintenance service or repair, and have no locking device or stabilizers. Bench rests of different types for shooting and sighting, adjusting scope. Portable tool boxes, one has two groves cut in top on each each end right, to fit a specific rifle. This would accept the rifle it was cut to fit, and hold it above the tool box same as the standard well known gun rack. Rifle would be loose not tight and would accept only one size rifle. This tool box one rifle top has no locking "tightening" device or stabilizers. Loose rifle, box would roc and be unstable.

The standard large padded vice used in repair shops is used for the bench lock or hold. Conventional vices do work but they are often too big and too powerful. Bradded vice locks are so bulky on the bench that there is usually insufficient room to work. Also, if the apparatus is too tight, damage to the firearm results. If too loose, an undesirable slip and "see-saw" action can result. Shop padded vices are bolted down for stability but they make forceful contact and hold only one point or section. This creates the "see-saw". Similarly these problems exist for butt, stock removal and or repair. Also firearm locked or viced into padded vice action can't be worked or tested, unless the firearm is appropriately loosened.

The key problem with the standard padded vice is well known and documented, repeated and stressed by all firearm's authorities, experts, teachers and instructors. To the firearm owner all of us who own firearms, we hear the constant admonition:

"if you are not an expert or don't know exactly what you are doing, do not under any circumstances lock up "vice in" or tighten up your firearm in a vice because of probable, almost certain damage to the firearm . . . "

A technician or a properly trained amateur should be trained for an appropriate "touch and power feel" before using constrictive vices on modern firearms. The smaller portable vice cradles rely on the vice lock in one form or another. The basic motto is "Screw into or tighten up." However, "easy grip handles" help to prevent over tightening, thus they are less likely to damage a serviced gun. Another prior art device incorporates a C-clam to "vice in" the firearm (i.e. to tighten it up.)

Another manufacturer of shooting rest "outers" advertises option vice clamps. But they all rely on the thread- nut principal be it wood or metal. Again the conventional motto is "Screw in to tighten up- Screw out to loosen up." In my research and study it became apparent that gun enthusiasts must try to improve the vice, to make a better vicing, and a less damaging vice. But what became strikingly apparent to me was the fact that noone had given thought to "stabilization." Some advertise a standard hardware type rubber or plastic grommet washer type feet on the bottom four corners to "prevent scratching and marring to bottom surface". This part was to confirm and be as proof that I do know and understand what I have stated.

SUMMARY OF THE INVENTION

The present invention comprises a unique work bench or gun cradle device adapted to conveniently "snap fit" and firmly support a firearm for maintenance, repair, modification, or the like. The work bench is adapted to temporarily and securely hold the firearm in any of a numerous variety of desired selectable positions without marring or damaging the surface of the metal or other parts of the firearm.

The workbench is preferably machined from plywood or similar soft wood. It includes a rigid, generally rectangular base adapted to be supported upon a suitable surface such as a table, shelf, or the like by a pair of stabilizers. The stabilizers are preferably adjustable, and they have four feet adapted to contact the supporting surface. A pair of vertically upright sides are firmly secured at opposite ends of the base. Each side terminates in a top in which a at least one firearm receptive groove is cut.

The firearm receptive grooves are smoothly curved, so that a gentle increase in compressive force is encountered by a firearm as it is "snap fitted" into the grooves. These grooves are provided with an overlying leather strap which permanently is affixed to the top, and which extends between suitable channels defined on opposite sides of the grooves. This permanent upper leather strap may thus be contacted by a firearm placed within the cradle, and the compliant, non-destructive surface of the leather will aid in creating frictional forces, while preventing damage to or scratching of the firearm.

In addition to the last mentioned strap, a reservoir of leather straps is affixed at the top of each side, adjacent the groove. One or more of the conveniently accessible leather straps held together in the reservoir may thus be utilized to provide a variably sized shim so as to insure that, as the firearm is firmly pressed into the grooves, it will be nondestructively firmly frictionally retained by the combined friction and compression forces so generated. Thus the grooves are operationally adapted to form an increasing friction effect as the firearm is snap fitted within them. During the snap fitting phenomena, an additional benefit is provided by of one or more surrounding leather strips which provide a shimming effect to nondestructively lock the firearm frictionally within the grooves, and to adapt it or accommodate it into the size of the receptive groove.

The operator may thus snap fit the firearm for work in a desired configuration, either upright, sideways, or upside down, by selecting the appropriate number of leather shimming straps and thereafter press fitting the firearm into the grooves. The leather strips develops a yieldable pressure to snugly, compressively fit the firearm into the grooves.

It is also preferred to provide at least one slot like recess on the top of the base, between the sides. These recesses form a handy storage area, which, by way of example, may temporarily receive parts of the firearm being serviced. In addition, certain tools or other miscellaneous parts may be conveniently, temporarily retained within these recesses during service.

Thus a fundamental object of the present invention is to provide a work bench for firearms which can accommodate a plurality of different sizes and types of firearms and which will not mar or damage their surface finish of the firearm being serviced.

A related object is to provide a firearm workbench of the character described which avoids the use of clamping vices or toothed jaws or the like.

Yet another object of the present invention is to provide a gun support bench or cradle which can nondestructively and firmly support and hold a firearm in a variety of different configurations. It is a feature of this invention that the stock, pistol grip, breech, trigger guard, forearm support and barrel portions of the firearm can be firmly received and at least temporarily retained within the cradle.

Yet another object of the present invention is to provide a reliable work bench for gunsmiths, firearm enthusiasts, and the like, which is lighter than the firearm being worked on, and which will work with either automatic, single shot, lever action, bolt action, or other firearms.

A still further object of the present invention is to provide a firearm work bench adapted to be manipulated as desired by the user to aid in a variety of routine firearm maintenance operations.

Another object of the present invention is to provide a gun cradle of the character described which is adapted to receive the trigger guard region of a firearm, enabling the gun to be turned sideways and temporarily nondestructively locked in a desired position.

Yet another object is to provide a gun cradle of the character described including appropriately arrayed sides presenting a plurality of shim-receptive holes or notches for firmly and nondestructively embracing a firearm.

A similar object is to provide a gun cradle or repair bench of the character described which will facilitate mounting of a firearm either upside down, sideways, or at a variety of other angles or configurations.

A still further object of the present invention is to provide a firearm work bench of the character described which is ideal for use when mounting or sighting a telescopic scope accessory.

Another object of the present invention is to provide a work bench of the character described which will fit short or long guns with or without scopes.

Another object of the present invention is to create a tool or device to hold a firearm and protect it.

A still further object is to provide a work bench that would be light, strong, and beautiful to the eye.

Another object of the invention is to provide a work bench that fits all rifles or shotguns without damaging them.

A similar object is to provide a work bench to hold firearms in the hitherto unheard of sideways position, either side up.

Another object of the present invention is to provide a portable work bench for bore sighting, scope mounting and scope adjusting.

A further object of the present invention is to provide a work bench for drilling and installing slang anchor pins, slangs and straps.

An object of the invention is to provide a workbench with a bench lock function with all action working, that locks in all function positions for major or minor repair without disturbing the scope.

An important object of the present invention is to provide a work bench that is simple and easy to assemble and disassemble.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views:

FIG. 1 is a perspective view of my PRESS FIT GUN CRADLE FOR FIREARM MAINTENANCE AND REPAIR constructed in accordance with the preferred embodiment;

FIG. 2 is a bottom, perspective view thereof;

FIG. 3 is a side elevational view thereof, with a firearm to be serviced shown coupled to the device in one of many possible orientations;

DETAILED DESCRIPTION

Figure 4:
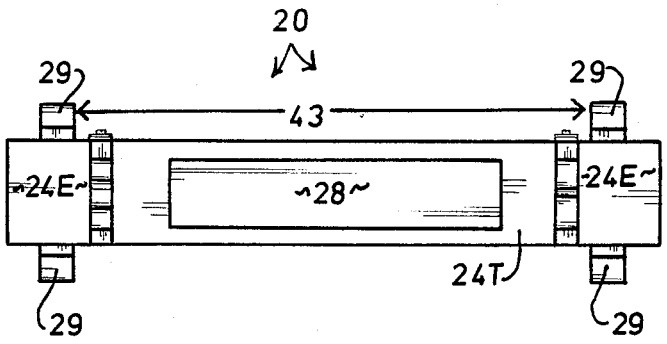
FIG. 4 is a top plan view thereof.

With reference now directed to the appended drawings, a gun cradle for firearms constructed in accordance with the best mode of the present invention has been broadly designated by the reference numeral 20. As best seen in FIG. 3, cradle 20 is adapted to hold a conventional firearm such as a shot gun 22 for service or repair. As will be explained hereinafter, the stock 22B of firearm 22 can be press fitted into and snugly retained by the apparatus 20 in a convenient position to facilitate service, adjustments, and the like. Concurrently, a frontal portion of the firearm, such as barrel 22E will be snugly received by the cradle at the opposite end thereof. While a shot gun has been illustrated, it will be appreciated that other firearms such as rifles including muzzle loaders can be semi-permanently retained in a conveniently accessible maintenance position by the cradle.

Cradle 20 preferably comprises a rigid, wooden rectangular base 24 having a width 25 and a length 26. The base is preferably planar, including a flat bottom 24B and a top 24T. The base includes a pair of opposite spaced apart ends generally designated by the reference numeral 24E. One or more shallow recesses 28 may be defined in the top 24T, so that as the firearm 20 is disassembled, parts thereof such as small screws, clips and the like may be conveniently stored in the recess 28.

Figure 5:
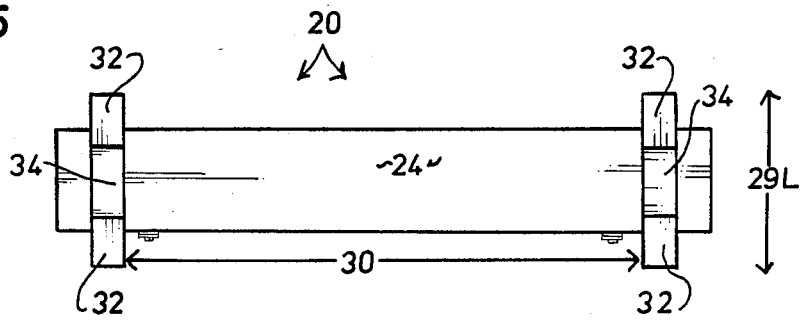
FIG. 5 is a bottom plan view thereof.

Preferably the base 24 is fitted with a pair of spaced apart stabilizers generally designated by the reference numeral 29. Stabilizers 29 are preferably parallel with one another, and they extend generally perpendicularly relative to the length of the base 24. As illustrated in FIG. 3, for example, the stabilizers 29 will elevate base 24 at a predetermined distance above the supporting surface 38. The distance between stabilizers 29 has been designated by the reference numeral 30. With reference to FIG. 5, the predetermined length of the stabilizers has been generally designated by the reference numeral 29L. The length 29L (FIG. 5) is greater than the width 25 (FIG. 1) of the base 24. Each stabilizer is preferably press-fitted into a suitable slot defined in the bottom of the base 24, as will be apparent from an inspection of FIG. 3. The opposite ends of the stabilizers are provided with suitable planar feet 32 disposed on opposite sides of a shallow recess 34 defined in the underside of each stabilizer. The stabilizer feet 32 are adapted to be disposed upon a suitable supporting surface such as surface 38. Supporting surface 38 may be provided by a table, work bench or the like.

Preferably apparatus 20 includes a pair of vertically upright, rigid, spaced-apart sides, broadly designated by the reference numerals 40 and 42. These rigid, spaced-apart sides 40 and 42 extend perpendicularly upwardly from the top surfaces 24T of the base. They are preferably received within suitable slots defined into the base top surface, as evidenced in FIG. 3. Thus the bottoms 41 (FIG. 3) is secured to the space, and extends to a top 44. In addition, the tops 44 of each side 40 or 42 are also equipped with suitable firearm receptive grooves 40G and/or 42G. As best viewed in FIG. 6, groove 40G has a larger diameter upper width, graduating into a lower diameter bottom width. Groove 42G, which preferably fits the stock or other wider or larger diameter portions of the firearm 22, is of a uniform but somewhat greater gradually tapering configuration. These grooves are normally aligned generally axially with one another, so that grooves 40G and 42G form a straight line generally parallel with the length of base 24. In this manner the firearm 22 will be supported within the gun cradle substantially above the lower recess 28 (FIG. 1). The distance 30 between the stabilizers is greater than the distance 43 (FIG. 4) between sides 40 and 42.

Figure 6:
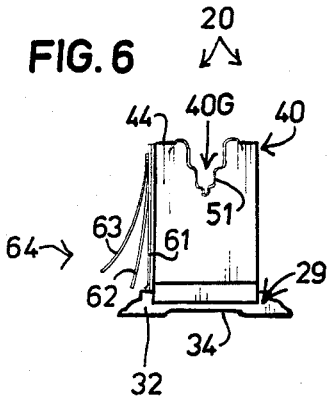
FIG. 6 is a left end elevational view thereof particularly showing the stabilizers and their feet.
Figure 7:
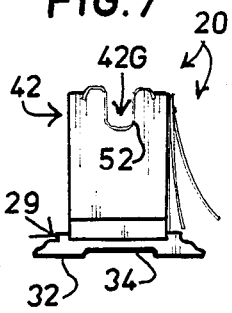
FIG. 7 is a right end elevational view thereof.
Figure 8:
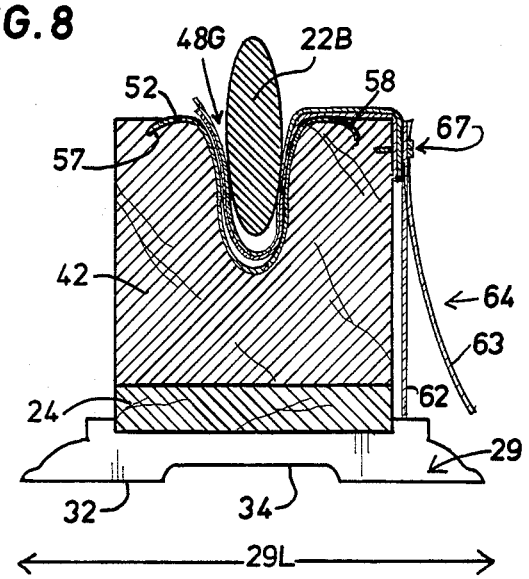
FIG. 8 is a fragmentary sectional view taken generally along line 8—8 of FIG. 3.

Preferably each of the grooves 40 and 42 are permanently lined with a compliant, leather strip affixed to the tops 44 of the sides 40 and 42. As best seen in FIGS. 6 and 7, side 40 includes an elongated leather strip 51 with extends throughout its internal contours, and side 42 includes a leather strip 52 disposed within groove 42G to line same. Both of these leather strips extends a major portion across the tops of each of the vertical sides, its ends being fitted into suitable terminal channels (FIGS. 6 and 7) defined in the tops of the sides 40 and 42 on opposite edges of the individual grooves 40G or 42G. It will thus be apparent that as a firearm is compressibly, frictionally slid into the groove, provided the thickness of the firearm is correct at that point, it will be compressibly retained in the groove against yieldable pressure from the permanent leather strips 51 or 52. With reference to FIG. 8, the permanent strap 52 fitted above the groove 42G is received within a pair of oppositely disposed permanent terminal channels 57 and 58. The terminal channels have been angularly cut into the tops 44 of the sides.

Thus as the gun stock 22B is frictionally press-fitted into the groove 42G, a frictional wedging effect will occur about the periphery of the gun stock 22B and the internal periphery if the groove, compression force being dissipated by the permanent leather strap 51, 52. In the best mode, however, a plurality of additional leather straps such as straps 61 through 63 (FIGS. 1 and 2) are employed. One or more of these additional straps may be coupled about a portion of the firearm to in effect provide a suitably dimensioned portion for press-fitting into the appropriate groove. In other words, one or more auxiliary straps 61–63 may be combined with the permanent leather straps to appropriately "shim" and retain a portion of the firearm within the confines of the respective groove. When a correct number of leather straps are wrapped about the firearm, it will compressively and snugly frictionally snap-fit within the grooves 40G and/or 42G respectively, provided in the cradle sides 40, 42.

Preferably each supply of straps is in the form of a convenient pile or reservoir of straps, generally designated by the reference numeral 64 (FIGS. 6, 7). Each reservoir of straps 64, thus comprises a plurality of individual, similarly configured, rectangular leather straps which are bunched together and screwed into the upper edges of one of the sides with a fastener such as screws 67 (FIG. 8). Thus reservoir 64 may be accessed by the user to individually select one or more reservoir leather straps, so that they may be swung upwardly (as viewed in FIG. 8) about the swivel in effect formed by screw 67, and thereafter lapped into the groove 42G or appropriately about at least a portion of the firearm so as to effectuate a semipermanent "snap-fit" effect in combination with a permanent strap affixed within the groove.

Figure 9:
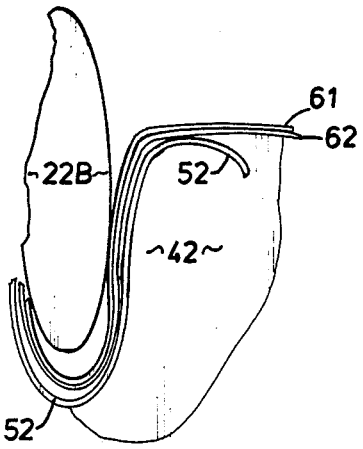
FIG. 9 is an enlarged, fragmentary, diagrammatic view similar to FIG. 8, illustrating the operational frictional contact points of the firearm stock and cradle when a firearm is installed as in FIG. 3; and, FIG. 10 is an enlarged, fragmentary sectional view illustrating the adjustable stabilizers.

As one places the stock into the cradle, the stock is pressed against the sides of the grooves within the cradle (FIGS. 8, 9). The more one presses down on the stock, the more solidly the stock is held in the cradle. Static friction is present between the stock and the cradle and it holds the stock from moving up or down, or fore and aft. The magnitude of the static friction force between two objects follows the empirically-derived formula $F=uN$, where F (friction) is the force of static friction between the two bodies, and u is the coefficient of friction of the two surfaces in contract and N is the normal force causing the two objects to be pressed together. The value for the coefficient of friction depends upon the "roughness" of the surfaces in contact. Rough surfaces (like sandpaper) have a high resistance to movement when placed together and one tries to move an object relative to the other. Likewise, smooth surfaces (oiled bearings) have a very low coefficient of friction to reduce friction between the two surfaces.

Static friction is friction which is present without motion between two surfaces. If one were to push on a large crate sitting on a floor, you would exert a certain amount of force before the crate would move. The force resisting your efforts to move the crate is static friction. Gun cradle 20 has static friction present where the stock and cradle come into contact as shown in FIGS. 8 and 9. The coefficient of friction is constant and fairly high because leather on wood has a lot of resistance to movement. As one pushes down on the stock forcing it further into the cradle there is a greater force created between the two surfaces. This greater force causes a larger static friction force to be present because friction is directly proportional to N. If one attempts to move the stock in any direction the static friction resists such movement.

Adding more leather straps to the cradle allows a gun with a small stock to be held firmly because the extra straps resolve the effective size of the cradle jaw. The coefficient of friction between the leather straps is quite high and the stock is held firmly. The gun - barrel cradle works on the same principle and has the cradle shaped so as to accommodate the smaller size of the barrel.

In the best mode preferred side dimensions are 7" high, 5" wide, and 1" thick. I cut a slot out of the top center that conforms to fit a hand grip on largest firearm to be accommodated, and the groove must be low enough but not too low as to interfere with telescope. The cut slot should be slightly bigger than the grip and at a very small incline inward at the bottom. The strips of leather form an integral part of my compression phenomena; they lock over top, down through and back up to top and over to near side. Two small vertical cuts were made in bother upper inside edges about ½ inch deep and ½ to ¾ inches outside to inside to accept these ends of leather strip. These are leather end locks to protect the leather ends. This rather odd locking slots form backbone of my locking system.

Leather strips are preferred for the locking action or system. Preferably strips are disposed in the "hanging reservoirs" depicted. A screw holds the reservoir of leather strips which hang vertically, ready to be rotated and then laid horizontally within the grooves for shimming. Both cradle ends are compression locks. The upright compression locks could now be mounted anywhere such as within a vehicle, on a boat, or on any convenient work bench.

The preferred base will use a thirty inch long board, five inches wide and one inch thick. I prefer to have my uprights 22" apart. On top of base board cut 1 inch slot across the width on both ends inches for each end, ¼ inch deep. On the bottom of base two identical cuts spaced from the end will form bottom grooves from which are offset from the top grooves. The stabilizers are preferably one foot long, 1 and ¼ inch high and one inch thick. When the two stabilizers are placed in the two bottom slots on the bottom of the base, additional leather straps or shims 101 (FIG. 10) may be placed in the region between the stabilizers and the grooves. Shimming in this fashion can provide stabilizer adjustment to accommodate supporting surfaces which are irregular or uneven.

Figure 10:
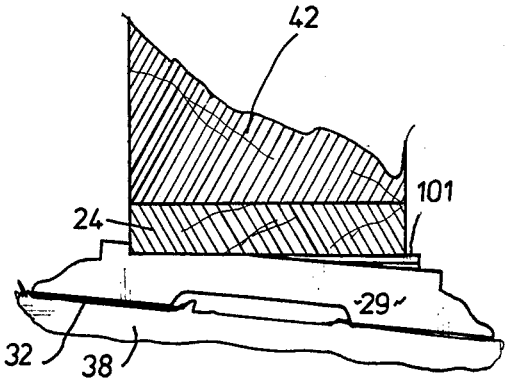

When the device is suitably installed and assembled, it is ready to accept all firearms and perform. The four corner feet should be checked to insure that they are all set perfectly flat, and touch the supporting surface without cradle rocking. The effective undersurface should be perfectly flat, and the device will thus be rock solid. If forced to use the device on a surface that is uneven or such as a dip, device can quickly and easily be adjusted. If foot will not touch loosen two end screws, press foot to surface, use small leather shim I have precut 1 inch by ¾ inch and slide it into the opening between top of stabilizer and bottom of base (FIG. 10). This shim fit gives perfect support in uneven areas. Then lay the firearm into the cradle in any desired position. The sideways position is self locking leather side up. No other gun cradle device will hold in a stable locked position either side up with actions working in a portable device.

The compression resistance lock function is referred to as "press lock." When the firearm is first laid into the cradle, it can easily move forward, backward - and up freely. When "press locked" in place in the desired orientation and position, the trigger guard can be maneuvered to a front or back position. One can then lift the firearm butt-end, holding with the left hand, and select with the right hand the "flip over leather strip" (from the reservoir) over the top of the compression groove. After the straps are oriented properly, then when one lowers the firearm, compression and resistance will be felt. Now the gun will be completely locked and stabilized rock solid. The system will not generate enough locking power to damage firearm's, it does those things I planned and more. Also my device will serve as a gun rack and may resemble a gun rack. Resemblance is as far as it goes.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense. In particular, it is to be realized that each cradle end may be fitted with one or more gun-receptive notches or grooves, so that a given cradle may accommodate more than one gun at once, or it may accommodate guns of different dimensions, as shown in my parent application.

What is claimed is:

1. A gun cradle for firearms for temporarily retaining said firearms without damage for maintenance, repair or adjustments, said gun cradle comprising:

a generally planar base having a top, an underside, a pair of opposed spaced-apart ends, a length, and a width, said base adapted to be disposed upon a supporting surface;

a pair of spaced-apart, parallel, generally horizontal stabilizers coupled to the underside of said base and extending generally perpendicularly relative to the length of said base for firmly and stably supporting said base upon said surface, said stabilizers having a predetermined length and said stabilizers spaced apart from one another a first preselected distance;

a pair of rigid, spaced-apart, vertical sides extending perpendicularly upwardly from said base near opposite ends thereof, each of said sides comprising a bottom secured to said base, a top, and at least one firearm-receptive groove formed in said top, said sides spaced apart from one another at a second preselected distance;

a leather strap permanently disposed upon said tops of each of said vertical sides, said strap lying within said grooves and forming a compliant, nondestructive surface to firmly brace said firearm when press-fitted into said grooves; and a plurality of additional leather straps adapted to suitably shim at least a portion of a firearm to enable it to be compressively and snugly frictionally fitted within said grooves in cooperation with said first mentioned leather straps, said plurality of straps comprising at least one reservoir of straps pivotally secured to at least one of said vertical sides adjacent said at least one firearm-receptive groove by a fastener so that one or more of said additional straps may be rotated relative to said fastener for subsequent deployment in said groove to aid in shimming.

2. The gun cradle as defined in claim 1 wherein said leather strap permanently disposed upon said tops has its ends fitted into terminal channels defined on opposite edges of each side.

3. The gun cradle as defined in claim 2 wherein said first preselected distance exceeds said second preselected distance.

4. The gun cradle as defined in claim 3 wherein said length of said stabilizers exceeds said width of said base.

5. A gun cradle for temporarily and non-destructively retaining firearms for maintenance, repair or adjustments, said gun cradle comprising:

a generally planar base having a top, an underside, a pair of opposed spaced-apart ends, a length, and a width, said base adapted to be disposed upon a supporting surface;

a pair of spaced apart stabilizers coupled to the underside of said base and extending generally perpendicularly relative to the length of said base for firmly and stably supporting said base upon said surface, said stabilizers having a predetermined length and said stabilizers spaced apart from one another a first preselected distance;

a pair of rigid, spaced-apart, vertical sides extending perpendicularly upwardly from said base near opposite ends thereof, each of said sides comprising a bottom secured to said base, a top, and at least one firearm-receptive groove formed in said top, said sides spaced apart from one another at a second preselected distance;

a permanent strap disposed upon said tops of each of said vertical sides, said strap lying within said grooves and forming a compliant, nondestructive surface to firmly brace said firearm when press-fitted into said grooves;

a reservoir of selectively deployable leather straps associated with each side for shimming of said firearm to enable the firearm to be compressively and snugly frictioanlly fitted and yieldably retained within said grooves in cooperation with said first mentioned leather straps, each reservoir pivotally secured by a fastener in said side adjacent said firearm-receptive groove so that one or more of said additional straps may be rotated relative to said fastener for subsequent deployment in said groove to aid in shimming said firearm.

6. The gun cradle as defined in claim 5 wherein said first preselected distance exceeds said second preselected distance.

7. The gun cradle as defined in claim 6 wherein said length of said stabilizers exceeds said width of said base.

8. A gun work bench for temporarily and nondestructively retaining firearms for maintenance, repair or adjustments, said gun work bench comprising:

a generally planar base having a top, an underside, a pair of opposed spaced-apart ends, a length, and a width, said base adapted to be disposed upon a supporting surface;

a pair of spaced apart, adjustable stabilizers coupled to the underside of said base and extending generally perpendicularly relative to the length of said base for firmly and stably supporting said base upon said surface, said stabilizers having a predetermined length and said stabilizers spaced apart from one another a first preselected distance;

a pair of rigid, spaced-apart, vertical sides extending perpendicularly upwardly from said base near opposite ends thereof, each of said sides comprising a bottom secured to said base, a top, and at least one firearm-receptive groove formed in said top, said sides spaced apart from one another at a second preselected distance;

wherein said first preselected distance is greater than said second preselected distance;

a permanent strap disposed upon said tops of each of said vertical sides, said strap lying within said grooves and forming a compliant, nondestructive surface to firmly brace said firearm when press-fitted into said grooves; and, a reservoir of selectively deployable leather straps associated with each side for shimming of said firearm to enable the firearm to be compressively and snugly frictionally fitted and yieldably retained within said grooves in cooperation with said first mentioned leather straps, each reservoir pivotally secured by a fastener in said side adjacent said firearm-receptive groove so that one or more of said additional straps may be rotated relative to said fastener for subsequent deployment in said groove to aid in shimming said firearm.

9. The work bench as defined in claim 8 wherein said length of said stabilizers exceeds said width of said base.

* * * * *